US010227158B2

(12) United States Patent
Miller, Jr.

(10) Patent No.: US 10,227,158 B2
(45) Date of Patent: Mar. 12, 2019

(54) BEVERAGE CONTAINER

(71) Applicant: Derrick T. Miller, Jr., Houston, TX (US)

(72) Inventor: Derrick T. Miller, Jr., Houston, TX (US)

( * ) Notice: Subject to any disclaimer, the term of this patent is extended or adjusted under 35 U.S.C. 154(b) by 656 days.

(21) Appl. No.: 13/868,855

(22) Filed: Apr. 23, 2013

(65) Prior Publication Data

US 2015/0136630 A1 May 21, 2015

Related U.S. Application Data

(60) Provisional application No. 61/681,022, filed on Aug. 8, 2012.

(51) Int. Cl.

| | |
|---|---|
| ***B65D 21/02*** | (2006.01) |
| ***B21D 51/26*** | (2006.01) |
| ***B65D 25/20*** | (2006.01) |
| ***B65D 6/28*** | (2006.01) |
| ***B65D 17/28*** | (2006.01) |

(52) U.S. Cl.

CPC ..... *B65D 21/023* (2013.01); *B21D 51/2669* (2013.01); *B65D 7/34* (2013.01); *B65D 17/4012* (2018.01); *B65D 21/022* (2013.01); *B65D 25/205* (2013.01); *B65D 2203/02* (2013.01); *B65D 2517/0014* (2013.01); *B65D 2517/507* (2013.01); *Y10T 29/49764* (2015.01)

(58) Field of Classification Search

CPC ..... B65D 17/165; B65D 25/34; B65D 2517/0013; B65D 25/36; B65D 23/0842

USPC ..... 220/270, 717, 719, 269, 508; 206/459.1, 206/459.5; 40/306, 310

See application file for complete search history.

(56) References Cited

U.S. PATENT DOCUMENTS

| | | | | |
|---|---|---|---|---|
| 3,272,671 | A * | 9/1966 | Gaylord et al. | 206/508 |
| 5,788,076 | A * | 8/1998 | Simmons | 206/459.5 |
| 6,126,029 | A | 10/2000 | Storgaard | |
| 6,202,881 | B1 * | 3/2001 | Chiang | 220/269 |
| 6,241,114 | B1 | 6/2001 | Savino et al. | |
| 6,349,974 | B1 * | 2/2002 | Grosskopf | B65D 23/003 40/299.01 |
| 6,425,493 | B1 * | 7/2002 | Gardiner | B65D 17/08 220/269 |

(Continued)

FOREIGN PATENT DOCUMENTS

| | | |
|---|---|---|
| JP | 11-147533 A | 6/1999 |
| JP | 2002-128088 A | 5/2002 |

*Primary Examiner* — Chun Cheung

(74) *Attorney, Agent, or Firm* — Plager Schack LLP; Mark H. Plager; Michael J. O'Brien

(57) ABSTRACT

An improved drinking can enables a user to have fluid return into the can after drinking The improved drinking can comprises a can body comprising a contoured bottom edge immediately adjacent to a bottom recess. The can body further comprising a can top mechanically coupled to a spout. Where the spout is shaped to funnel fluid back into the can body. The bottom recess is shaped to enable a first improved drinking can to sit upon a second improved drinking can where bottom recess covers can top. This protects the drinking area from becoming contaminated during shipment, storage, and display. The can body is covered with a mural where the mural is covered by a mural cover comprising a tab such that the mural cover can be removed by applying force to the tab displaying the mural.

16 Claims, 5 Drawing Sheets

(56) References Cited

U.S. PATENT DOCUMENTS

| | | | | |
|---|---|---|---|---|
| 6,435,368 | B1 | 8/2002 | Yamanaka et al. | |
| 2011/0100854 | A1* | 5/2011 | Chapin | 206/459.5 |

* cited by examiner

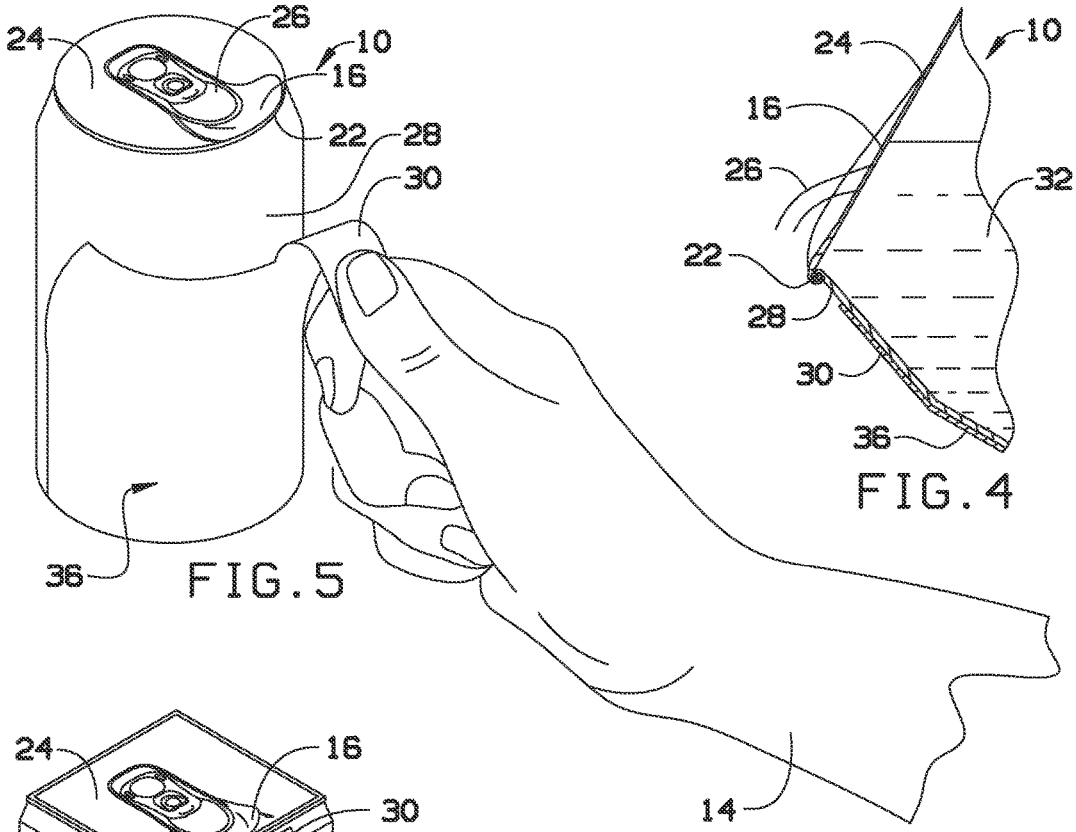
FIG. 5
FIG. 4
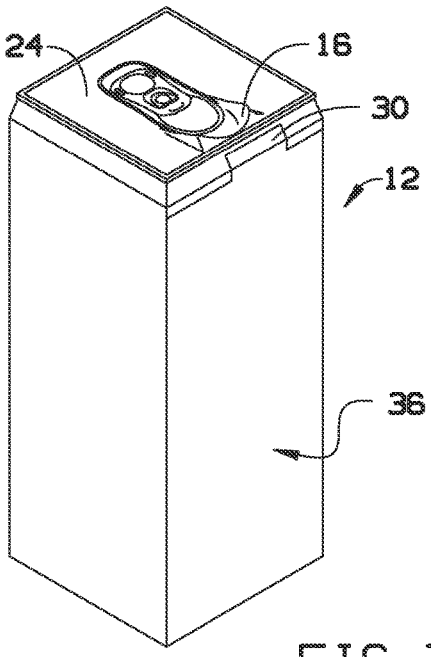
FIG. 7
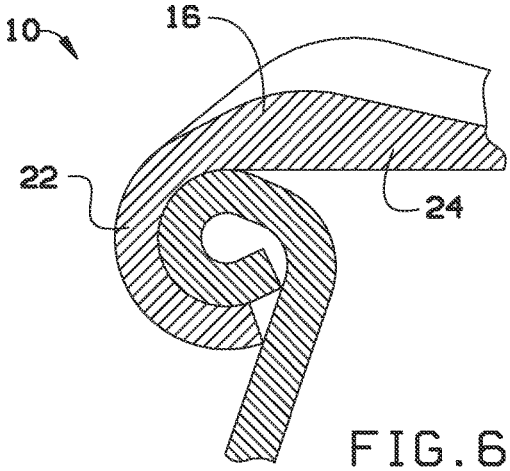
FIG. 6

BEVERAGE CONTAINER

CROSS REFERENCE TO RELATED APPLICATIONS

This application claims priority to U.S. Provisional Application 61/681,022 filed on Aug. 8, 2012.

FIELD OF THE INVENTION

This invention relates to devices, which can temporarily hold liquids.

BACKGROUND OF THE INVENTION

The construction of prior art beverage containers causes a series of poor hygienic conditions. In particular after consuming a small amount of beverage some beverage remains on the lip of a prior art can. The present invention solves this problem with a ramped lip. The ramped lip is a smooth surface easily cleaned, for the flow from the can to the user's mouth. The ramped lip also directs the fluid directly back into the can instead of leaving it in lip of the prior art can.

A method of making an improved drinking can comprises the following steps. First, a user loads metal coils onto a rolling mill and inserting the metal coils into an uncoiler. Next, the user unrolls the metal coils creating a metal sheet and feeding the metal sheet into a lubricator. Then the user deposits a thin film of water-soluble lubricant on both sides of the metal sheet. After that a user cuts a circular disc from the metal sheet and forming the circular disc into a cup. Next, the user forms the cup onto a punch. Subsequently, the user forces the cup through a series of progressively smaller circular ironing rings forming a can body. After this the user forms a bottom of the can body into a plateau shape such that a peak of the plateau shape is inside a can body creating a bottom recess and a contoured bottom edge. Then the user trims a top of the can body to a uniform height. After that the user washes the can body to remove the thin film of water-soluble lubricant. Next, the user dries the can body creating an improved drinking can.

BRIEF SUMMARY OF THE INVENTION

An improved drinking can enables a user to have fluid return into the can after drinking The improved drinking can comprises a can body comprising a contoured bottom edge immediately adjacent to a bottom recess. The can body further comprising a can top mechanically coupled to a spout. Where the spout is shaped to funnel fluid back into the can body. The bottom recess is shaped to enable a first improved drinking can to sit upon a second improved drinking can where bottom recess covers can top. This protects the drinking area from becoming contaminated during shipment, storage, and display. The can body is covered with a mural where the mural is covered by a mural cover comprising a tab such that the mural cover can be removed by applying force to the tab displaying the mural.

BRIEF DESCRIPTION OF THE SEVERAL VIEWS OF THE DRAWINGS

Figure 1:
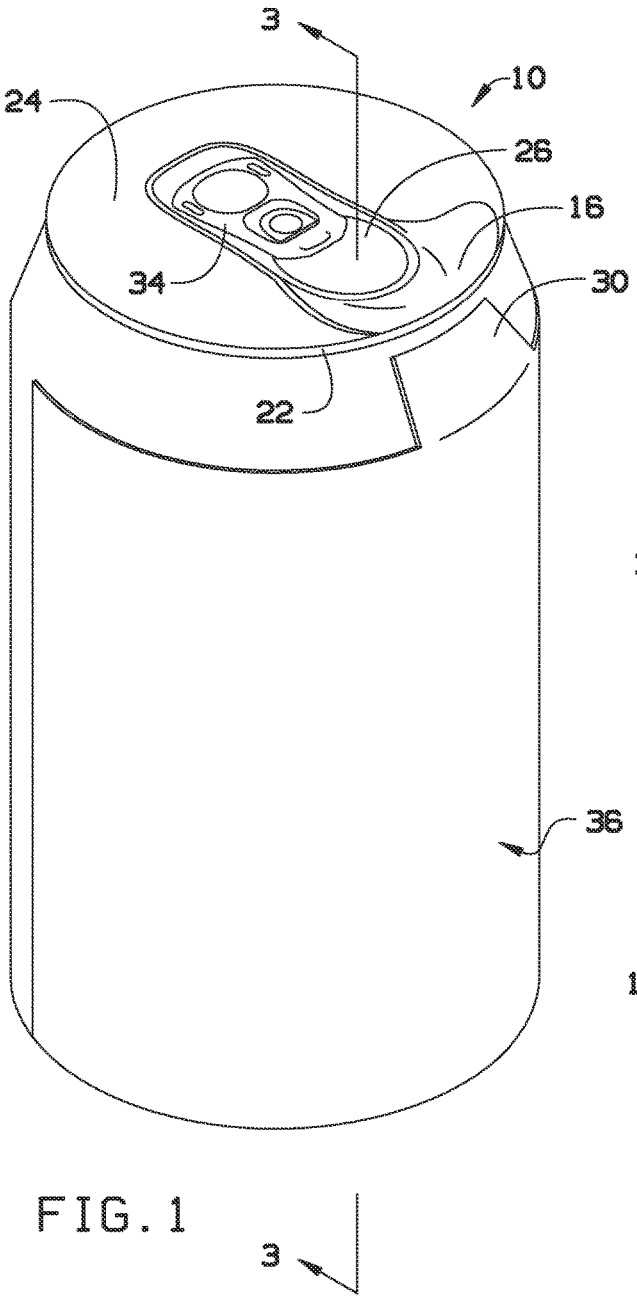

Having thus described the invention in general terms, reference will now be made to the accompanying drawings, which are not necessarily drawn to scale, and wherein:

FIG. 1 is a perspective view of the invention.

Figure 2:
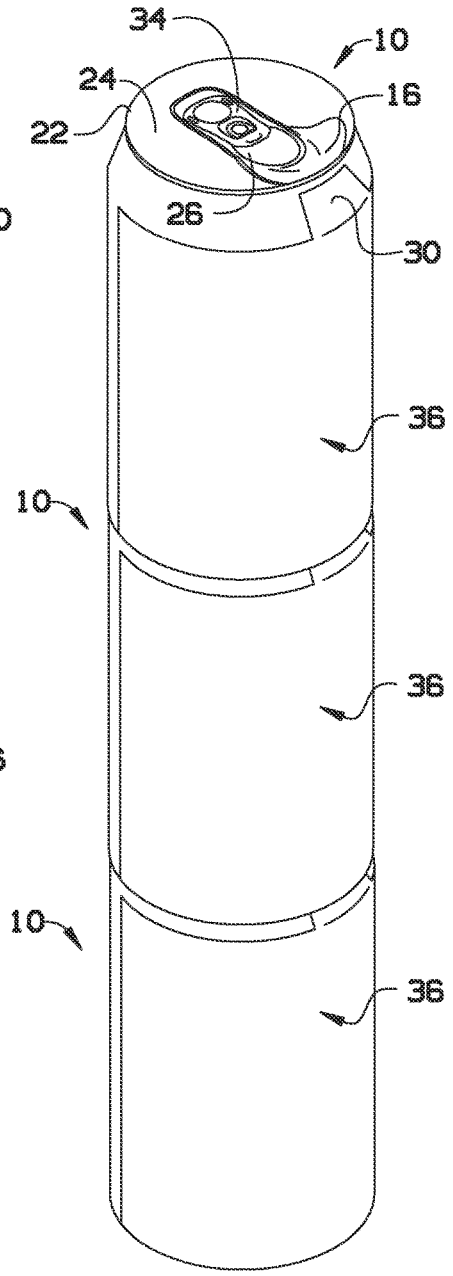

FIG. 2 is a perspective view of the invention shown in stacked configuration.

Figure 3:
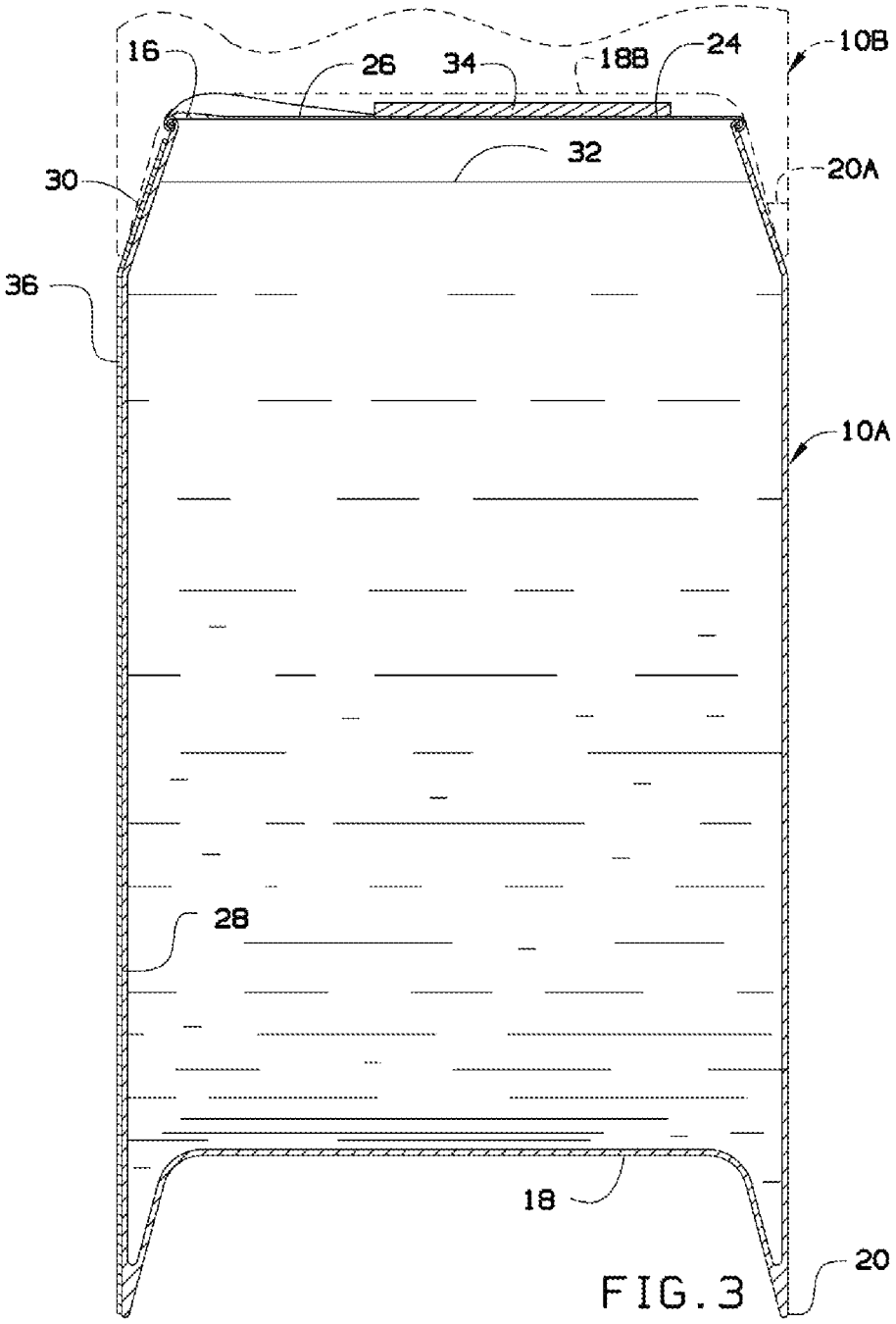

FIG. 3 is a section view of the invention along line 3-3 in FIG. 1.

Figure 3A:
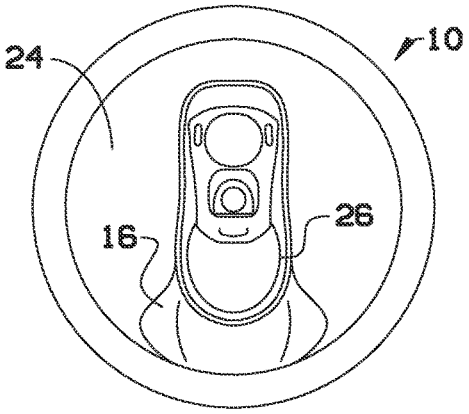

FIG. 3A is a top view of the invention.

Figure 3B:
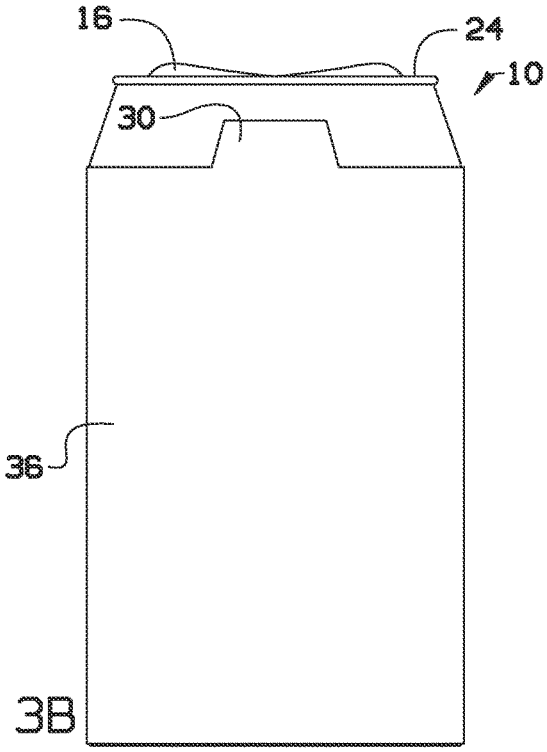

FIG. 3B is a front view of the invention.

FIG. 4 is a section detail view of the invention illustrated in pouring configuration.

FIG. 5 is a perspective view of the invention illustrating peeling the mural.

FIG. 6 is a section detail view of the invention detailing the inverted seal.

FIG. 7 is a perspective view of an alternate embodiment of the invention.

Figure 8:
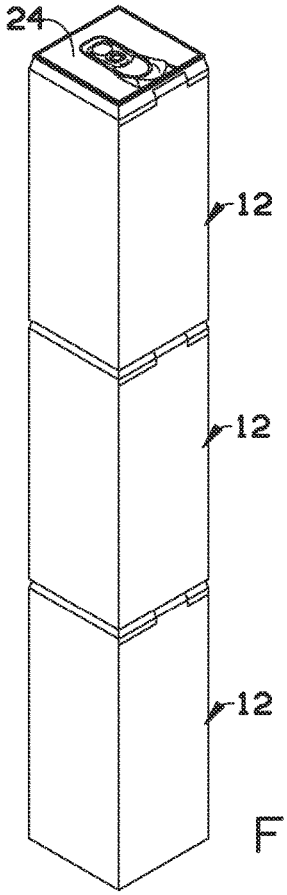

FIG. 8 is a perspective view of an alternate embodiment of the invention shown in stacked configuration.

Figure 9:
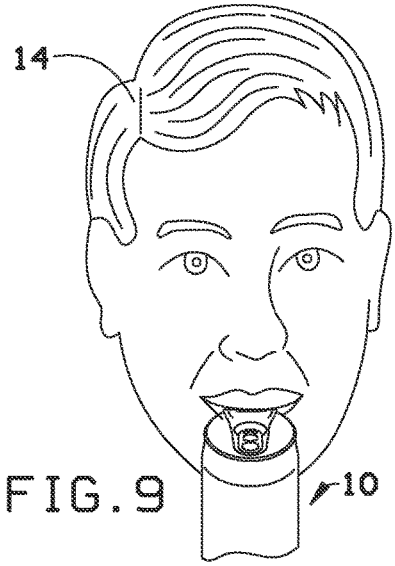

FIG. 9 is a detail perspective view of the invention shown in use.

Figure 10:
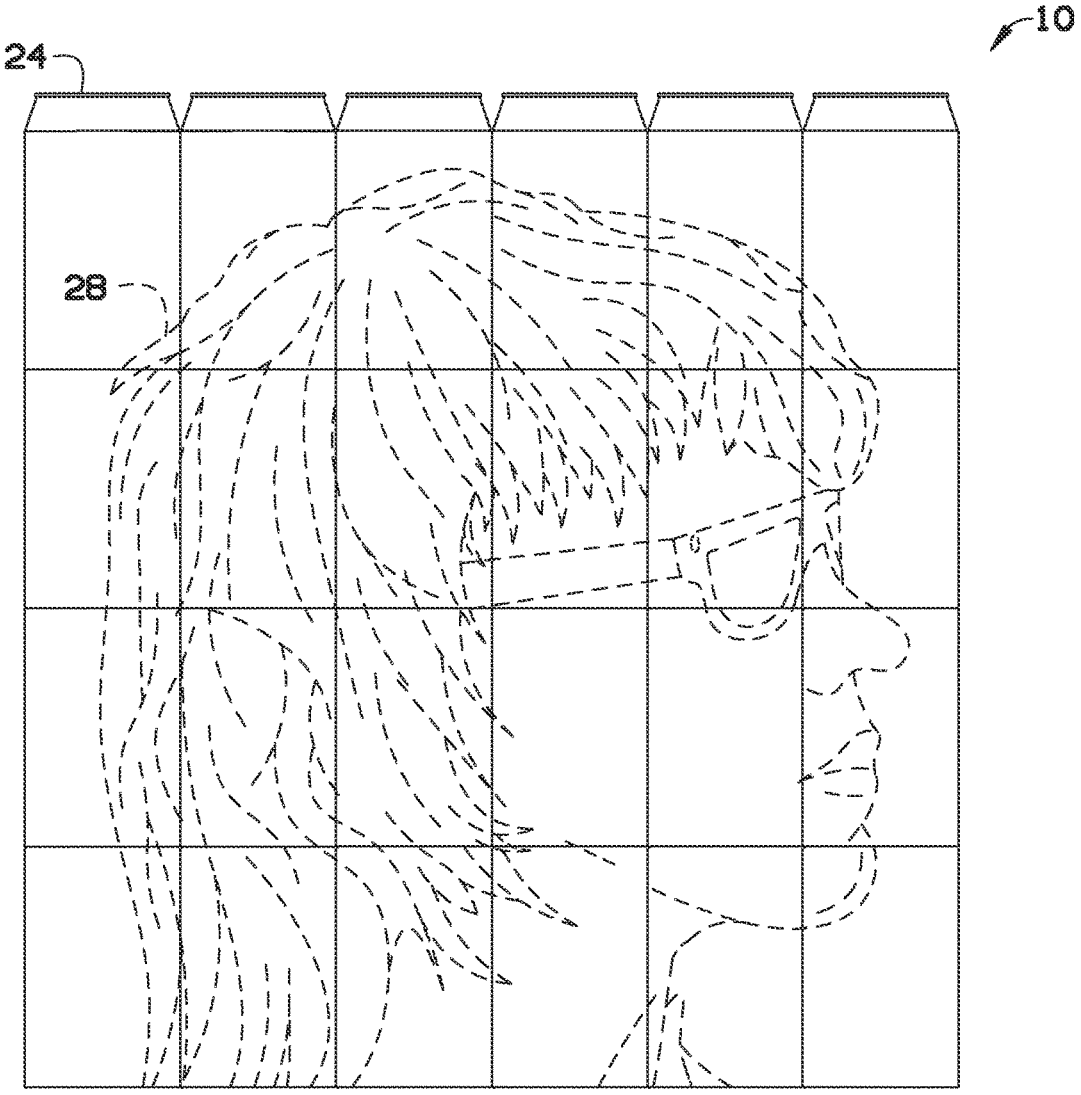

FIG. 10 shows a side view of an embodiment of the invention.

DETAILED DESCRIPTION OF THE INVENTION

Embodiments of the present invention overcome many of the obstacles associated with drinking from a can in a sanitary manner, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows a perspective view of the device and FIG. 9 shows the device in use. Round improved drinking can 10 comprises can top 24. Can top 24 comprises can spout 26 which is proximate ramped lip 16. Can top 24 is encircled by inverted seal 22. Round improved drinking can 10 can be decorated with partial mural 28 that can be easily revealed by removing mural tab 30 as shown in FIG. 5. Mural tab 30 is immediately adjacent to outer mural 36. Outer mural 36 has an inside mural and an outside mural. The outside mural 36 can hold traditional can design information such as a logo, nutritional information and so on. The inside mural 36 can contain tracking information such as a copy of the design or information on the outside mural 36 with a Quick Response (QR) code, a barcode and/or a serial number.

Another feature of round improved drinking can 10 is the ability to be stacked vertically as shown in FIG. 2. This is because of the construction bottom recess 18, counter bottom edge 20 and can top 24 as shown in FIG. 3.

FIG. 3 shows a section view of round improved drinking can 10. Round improved drinking can 10 comprises can top 24 which further comprises can spout 26 and ramped lip 16 as shown in FIG. 1. The bottom of round improved drinking can 10 comprises contoured bottom edge 20, which is mechanically coupled to bottom recess 18. Bottom recess 18 is shaped to enable a first round improved drinking can 10A to sit upon a second round improved drinking can 10B such that bottom recess 18B covers can top 24. Liquid 32 rests in round improved drinking can 10 when round improved drinking can 10 is not in use.

FIG. 3A and FIG. 3B shows a top view and side view of round improved drinking can 10. Liquid 32 can be accessed from can top 24 by engaging can spout 26 and then tipping round improved drinking can 10 to cause liquid 32 to move into ramped lip 16 and then to a location desired by the user.

FIG. 4 shows round improved drinking can 10 slightly tipped on its side as though in use. Can spout 26 can be recessed in order to access liquid 32 via ramped lip 16. Notably, once round improved drinking can 10 returns to a horizontal position as shown in FIG. 3B, liquid 32 will return into round improved drinking can 10 by gravity and will avoid the unsanitary condition of prior art cans which involve fluid remaining in the lip of the prior art can. Another advantage over prior art cans is inverted seal 22 which mechanically couples can top 24 to the rest of round improved drinking can 10 which is shown in more detail in FIG. 6.

Another advantage over prior art, shown in FIG. 5 is the ease with which partial mural 28 can be revealed by a user simply pulling on tab 30. The "mural" component can produce any type of abstract image by placing parts/fractions of a picture onto individual murals 28 for sale so that when the units are assembled together the whole picture can be viewed communicating a message. The effect can be also applied by using whole individual pictures to build a unique abstract mural from the collage of individual pictures on round improved drinking cans 10.

FIG. 6 shows the design of inverted seal 22. This curled design helps to prevent a failure that occurs when can top 24 is revealed in an area other than can spout 26 when can spout 26 is activated as indicated above. Further, inverted seal 22 provides greater structural support to can top 24 and can prevent implosion.

FIG. 7 and FIG. 8 show square improved drinking can 12. Similar to round improved drinking can 10, square improved drinking can 12 comprises can top 24. Can top 24 comprises can spout 26 which is proximate ramped lip 16. Can top 24 is encircled by inverted seal 22. Square improved drinking can 12 can be decorated with partial mural 28 that can be easily revealed by mural tab 30 in the same manner as round improved drinking can 10 shown in FIG. 5.

Both round improved drinking can 10 and square improved drinking can 12 can be stacked using a "outside stack" technique shown in FIG. 2 and FIG. 8. The "outside stack" in the design refers to how the system 'mounts' onto the outside the top of the can. This type of stacking system protects the drinking area from becoming contaminated during shipment, storage, and display.

As shown in FIG. 10, partial mural 28 from a plurality of improved drinking cans 10 can create a complete mural. This is more than artfully arranging similarly decorated cans, but rather having each improved drinking can 10 contain a complete and distinct partial mural 28 that can be used to communicate a message.

The improved drinking can, whether round improved drinking can 10 or square improved drinking can 12 can be made in the following manner. Metal coils are loaded onto rolling mill and inserted into an uncoiler at the beginning of the process. The uncoiler unrolls the strip of metal and feeds the strip of metal into the lubricator. Next, the lubricator deposits a layer of lubricant such as a thin film of water-soluble lubricant on both sides of the metal sheet. This is because lubrication allows the metal to flow smoothly over the tooling surfaces during the forming processes that follow.

Metal forming begins in a cupping press, such as the progeny of U.S. Pat. No. 2,411,503 issued to Calleson. The cupping press cuts circular discs from the metal sheet and forms them into cups, which will form the can body.

The cups drop from the cupping press onto the cup conveyor. These two metal-forming operations are called blank and draw in the prior art. Any scrap metal left over is removed for recycling. After this, a cup conveyer moves the cups to one of a series of bodymakers where the improved drinking can is made in a step process. Bodymakers are known metal working tools as explained in U.S. Pat. No. 7,434,442 issued to Gombas.

Each 'bodymaker' comprises a punch, which forms the shape of the improved drinking can by forcing the cup through a series of progressively smaller circular ironing rings. This action literally draws the metal up the sides of the punch, ironing it into a can body. As the cup is forced through the rings, its diameter is reduced, walls of the cup are thinned and a height of the cup is increased creating the improved drinking can depending on user preference. At the end of the punch stroke, the bottom is formed into a plateau shape such that a peak of the plateau shape is inside a can body creating a bottom recess and a contoured bottom edge. This strengthens the bottom of the can while forming bottom recess 18 and contoured bottom edge 20.

During this process, referred to as wall ironing, the improved drinking can should be lubricated to reduce frictional heat. The lubricant can be constantly recirculated through a filter and reused. The improved drinking can is released from bodymaker and trimmed, at the top, mechanically to a uniform height. Forming can top 24. The trimmed-off scrap is recycled.

The can bodies are sent through a washer that removes the forming lubricants. After this, the washed can bodes are discharged to a dryer where they are dried with forced hot air and then moved to a decorator or a printer.

The decorator applies partial mural 28 to the outside of the improved drinking The improved drinking can is then conveyed through the decorator on a mandrel, which rotates improved drinking can 10 in contact with a printing blanket.

The improved drinking can, now coated with wet ink, moves to a rotating varnish application roll that applies a clear coating over the entire can sidewall. The clear coating protects partial mural 28 from scratching and contains lubricants that facilitate conveying onto the improved drinking can. The improved drinking can is transferred from the decorator onto a pin so that only an inside surface of the improved drinking can is contacted and is conveyed through a decorator oven where partial mural 28 is dried with forced hot air. Following application and curing of the exterior label (lithography) with the can decorator, the improved drinking can is conveyed to a bank of spray machines that spray the inside of the improved drinking can with an epoxy-based organic protective coating. The epoxy-based organic protective coating is then cured by forced hot air. This coating prevents the beverage from contacting or reacting with the metal in the can body.

After the improved drinking can leaves forced air oven, it passes through a lubricator that applies a thin film of lubricant to the exterior of the can top 24 where inverted seal 22 will be formed. Inverted seal 22 will eventually be sealed into place after the improved drinking can is filled.

Next, the improved drinking can is evaluated for leakage with a light tester. Can top 24 is clamped against a sealing surface and, as the sealing machine rotates, an outside surface of the improved drinking can is exposed to a bank of extremely bright lights. A photocell inside the can detects any entering light, triggering a reject mechanism. A rejected improved drinking can is recycled.

Can spout 26 can be made in the following manner, a coil of metal is placed on an uncoiler. The metal is pre-coated on both sides with organic protective coatings containing lubricants. The uncoiler feeds the metal directly into a shell press, which is similar to the cupping press in the can body manufacturing process. The shell press blanks a circular disc and forms it into the shell of can spout 26.

Can spout 26 is discharged through a curler that forms the precise shape required for inverted seal 22 seam formation the operation which seals can top 24 to can spout 26 after the can is filled. After curing, a liquid sealing compound is applied to can top 24. The shell of can spout 26 is moved onto a conversion press where a score or opening area is formed and a tab is attached.

Mural cover 36 is manufactured in the following manner. A coil of material such as paper, plastic or metal is placed on an uncoiler. The material used for tab 30 manufacture is pre-coated on both sides with organic protective coatings containing lubricants. The uncoiler feeds the plate directly into a shell press, which is similar to the cupping press in the manufacturing process for can top 24. The shell press creates a form, with a tab which creates tab 30. Tab 30 is then sent through a washer that removes the forming lubricants. Tab 30 is discharged to a dryer where it is dried with forced hot air and then moved to the decorator or printer.

The decorator or printer applies the label and other marketable logos/nutritional information, bar & QR codes, etc. to the front and back of the tab 30. Tab 30 is conveyed through the decorator on a mandrel, which moves tab 30 in contact with a printing press/blanket. The tab 30 shell is then discharged through a curler that forms the precise shape required for tab 30 to be affixed to the sidewalls of the can body, covering mural cover 36. After curing, an affixing/sealing compound is applied to protect the printed aspects of tab 30 and partial mural 28.

That which is claimed:

1. An improved drinking can enables a user to efficiency stack several improved drinking cans, the improved drinking can comprises, a can body comprising a can side wall terminating in a contoured bottom edge wherein the contoured bottom edge further comprises a central flat section immediately adjacent to a bottom recess inclined at a bottom recess angle; wherein a cavity exists between the can side wall and the bottom recess around the contoured bottom edge that is configured to store a liquid; the bottom recess is shaped to enable a first improved drinking can to sit upon a second improved drinking can wherein the bottom recess covers a second can top; wherein the bottom recess angle is parallel to and adjacent to an upper portion of the second can body; said central flat section of and the bottom recess of the contour bottom edge complements the second can top without leaving a space therebetween when the cans are stacked; this protects a drinking area from becoming contaminated during shipment, storage, and display.

2. The improved drinking can of claim 1, the can body further comprises a can top mechanically coupled to a spout at one end nearest a can opening terminating at each side of the can opening;

wherein the spout is arranged above the can top having a funnel that directs fluid from a front and sides of an opening area into the can body.

3. The improved drinking can of claim 1, the can body further comprises a can top mechanically coupled to the can body with an inverted seal to prevent implosion wherein the inverted seal comprises the can body directly truncating to the can top the directly wrapping into a half loop and the can top wrapped over the can body.

4. The improved drinking can of claim 1, the can body is covered with a mural conveying a message.

5. The improved drinking can of claim 1, the can body is partially covered by a mural cover comprising an outside mural and an inside mural and a tab such that the mural cover can be removed by applying force to the tab to reveal non-identical information on the outside mural and inside mural and a mural on the can body.

6. The improved drinking can of claim 1, the can body further comprises a can top mechanically coupled to a spout at one end nearest a can opening terminating at each side of the can opening;

wherein the spout is arranged above the can top having a funnel that directs fluid from a front and sides of an opening area into the can body; and the can top is mechanically coupled to the can body with an inverted seal to prevent implosion.

7. The improved drinking can of claim 1, the can body further comprises a can top mechanically coupled to a spout at one end nearest a can opening terminating at each side of the can opening;

wherein the spout is arranged above the can top having a funnel that directs fluid from a front and sides of an opening area into the can body; and the can body is covered with a mural conveying a message.

8. The improved drinking can of claim 1, the can body further comprises a can top mechanically coupled to a spout at one end nearest a can opening terminating at each side of the can opening;

wherein the spout is arranged above the can top having a funnel that directs fluid from a front and sides of an opening area into the can body; and the can body is partially covered by a mural cover comprising an outside mural and an inside mural and a tab such that the mural cover can be removed by applying force to the tab to reveal non-identical information on the outside mural and inside mural and a mural on the can body.

9. The improved drinking can of claim 1, the can body further comprises a can top mechanically coupled to the can body with an inverted seal to prevent implosion; and the can body is covered with a mural conveying a message.

10. The improved drinking can of claim 1, the can body further comprises a can top mechanically coupled to the can body with an inverted seal to prevent implosion wherein the inverted seal comprises the can body directly truncating to the can top the directly wrapping into a half loop and the can top wrapped over the can body; and the can body is partially covered by a mural cover comprising an outside mural and an inside mural and a tab such that the mural cover can be removed by applying force to the tab to reveal non-identical information on the outside mural and inside mural and a mural on the can body.

11. The improved drinking can of claim 1, the can body is partially covered by a mural cover comprising an outside mural and an inside mural and a tab such that the mural cover can be removed by applying force to the tab to reveal non-identical information on the outside mural and inside mural and a mural on the can body; and the can body is covered with a mural conveying a message.

12. The improved drinking can of claim 1, the can body further comprises a can top mechanically coupled to a spout at one end nearest a can opening terminating at each side of the can opening;

wherein the spout is arranged above the can top having a funnel that directs fluid from a front and sides of an opening area into the can body;

the can body further comprises a can top mechanically coupled to the can body with an inverted seal to prevent implosion wherein the inverted seal comprises the can body directly truncating to the can top the directly wrapping into a half loop and the can top wrapped over the can body; and the can body is partially covered by a mural cover comprising an outside mural and an inside mural and a tab such that the mural cover can be removed by applying force to the tab to reveal non-identical information on the outside mural and inside mural and a mural on the can body.

13. The improved drinking can of claim 1, the can body further comprises a can top mechanically coupled to a spout at one end nearest a can opening terminating at each side of the can opening;

wherein the spout is arranged above the can top having a funnel that directs fluid from a front and sides of an opening area into the can body;

the can top is mechanically coupled to the can body with an inverted seal to prevent implosion; and the can body is covered with a mural conveying a message.

14. The improved drinking can of claim 1, the can body further comprises a can top mechanically coupled to a spout at one end nearest a can opening terminating at each side of the can opening;

wherein the spout is arranged above the can top having a funnel that directs fluid from a front and sides of an opening area into the can body;

the can body is partially covered by a mural cover comprising an outside mural and an inside mural and a tab such that the mural cover can be removed by applying force to the tab to reveal non-identical information on the outside mural and inside mural and a mural on the can body; and the can body is covered with a mural conveying a message.

15. The improved drinking can of claim 1, the can body further comprises a can top mechanically coupled to the can body with an inverted seal to prevent implosion wherein the inverted seal comprises the can body directly truncating to the can top the directly wrapping into a half loop and the can top wrapped over the can body;

the can body is partially covered by a mural cover comprising an outside mural and an inside mural and a tab such that the mural cover can be removed by applying force to the tab to reveal non-identical information on the outside mural and inside mural and a mural on the can body; and the can body is covered with a mural conveying a message.

16. The improved drinking can of claim 1, the can body further comprises a can top mechanically coupled to a spout at one end nearest a can opening terminating at each side of the can opening;

wherein the spout is arranged above the can top having a funnel that directs fluid from a front and sides of an opening area into the can body;

the can body further comprises a can top mechanically coupled to the can body with an inverted seal to prevent implosion wherein the inverted seal comprises the can body directly truncating to the can top the directly wrapping into a half loop and the can top wrapped over the can body;

the can body is partially covered by a mural cover comprising an outside mural and an inside mural and a tab such that the mural cover can be removed by applying force to the tab to reveal non-identical information on the outside mural and inside mural and a mural on the can body; and the can body is covered with a mural conveying a message.

* * * * *